US011780692B2

(12) United States Patent
Nguyen

(10) Patent No.: US 11,780,692 B2
(45) Date of Patent: Oct. 10, 2023

(54) IMAGE FORMING APPARATUS

(71) Applicant: KYOCERA Document Solutions Inc., Osaka (JP)

(72) Inventor: Danh Chien Nguyen, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 128 days.

(21) Appl. No.: 17/490,935

(22) Filed: Sep. 30, 2021

(65) Prior Publication Data

US 2022/0097987 A1 Mar. 31, 2022

(30) Foreign Application Priority Data

Sep. 30, 2020 (JP) ..... 2020-165055

(51) Int. Cl.

*B65H 3/06* (2006.01)
*G03G 15/00* (2006.01)
*B65H 1/02* (2006.01)

(52) U.S. Cl.

CPC ..... *B65H 3/0669* (2013.01); *B65H 1/02* (2013.01); *B65H 3/0684* (2013.01); *G03G 15/6511* (2013.01); *B65H 2402/45* (2013.01); *B65H 2403/51* (2013.01); *B65H 2403/533* (2013.01); *B65H 2403/73* (2013.01); *B65H 2801/06* (2013.01)

(58) Field of Classification Search

CPC ..... B65H 3/0669; B65H 3/0684; B65H 2402/441; B65H 2402/443; B65H 2402/45; B65H 2402/60; B65H 2403/533; B65H 2403/5331; B65H 2403/5332; B65H 2403/70; B65H 2403/72; B65H 2403/721; B65H 2403/73; B65H 2403/731

See application file for complete search history.

(56) References Cited

U.S. PATENT DOCUMENTS 6,578,840 B1 * 6/2003 Kudo ..... B65H 3/0669 271/10.08
8,894,061 B2 * 11/2014 Matsuoka ..... B65H 5/06 271/10.13
2005/0084290 A1 4/2005 Baek et al.
2008/0012200 A1 * 1/2008 Lin ..... B65H 3/0669 271/10.13

(Continued)

FOREIGN PATENT DOCUMENTS

JP 2005-122137 A 5/2005

*Primary Examiner* — Prasad V Gokhale
(74) *Attorney, Agent, or Firm* — Studebaker & Brackett PC

(57) ABSTRACT

An image forming apparatus includes a main body housing, an openable/closable part, a sheet feeding tray, an image forming device, a sheet feeding roller, a first coupling, a drive gear, a second coupling, a biasing member, and a link mechanism. The first coupling is provided in the sheet feeding roller. The second coupling is provided coaxially with the drive gear, rotatable following the drive gear, slidable relative to the drive gear in an axial direction and capable of fitting to the first coupling. The biasing member biases the second coupling to the first coupling to connect the second coupling to the first coupling. The link mechanism disconnects the second coupling from the first coupling against a biasing force of the biasing member so as to block a transmission of the drive force with an opening of the openable/closable part.

11 Claims, 11 Drawing Sheets

(56) References Cited

U.S. PATENT DOCUMENTS

2009/0267293 A1* 10/2009 Watanabe ..... B65H 3/0638
271/264
2017/0142265 A1* 5/2017 Horikawa ..... H04N 1/00628

* cited by examiner

IMAGE FORMING APPARATUS

INCORPORATION BY REFERENCE

This application is based on and claims the benefit of priority from Japanese patent application No. 2020-165055 filed on Sep. 30, 2020, which is incorporated by reference in its entirety.

BACKGROUND

The present disclosure relates to an image forming apparatus.

The image forming apparatus is provided with a sheet feeding roller which feeds a sheet placed on a tray to an image forming device. When the sheet is jammed in the sheet feeding roller, because the sheet is restrained by the sheet feeding roller while the sheet feeding roller is connected to a drive gear, it is difficult to remove the sheet. Therefore, it is necessary to disconnect the sheet feeding roller from the drive gear, but when the sheet feeding roller is disposed in an inner position of the main body housing, it takes time to disconnect the sheet feeding roller from the drive gear. Then, a technique for making an attachment and detachment of a unit provided in the image forming apparatus simple has been discussed. For example, an image forming apparatus is proposed, which includes a guide projection provided in a transfer unit, a guide rail for guiding the guide projection, and a damping unit for holding the transfer unit elastically so that an impact is not transmitted to the transfer unit when the transfer unit is attached.

However, the operation for removing the sheet feeding roller in order to disconnect the feeding roller from the drive gear applies a great burden to the user. It is preferable for the user to disconnect the sheet feeding roller from the drive gear without detaching the sheet feeding roller.

SUMMARY

In accordance with an aspect of the present disclosure, an image forming apparatus includes a main body housing, an openable/closable part, a sheet feeding tray, an image forming device, a sheet feeding roller, a first coupling, a drive gear, a second coupling, a biasing member, and a link mechanism. The openable/closable part is provided in the main body housing in a turnable manner around a hinge. On the sheet feeding tray, a sheet is placed. The image forming device forms an image on the sheet. The sheet feeding roller rotates around an axis parallel to the hinge and feeds the sheet placed on the sheet feeding tray to the image forming device. The first coupling is provided in the sheet feeding roller. The drive gear transmits a drive force to the sheet feeding roller. The second coupling is provided coaxially with the drive gear, rotatable following the drive gear, slidable relative to the drive gear in an axial direction and capable of fitting to the first coupling. The biasing member biases the second coupling to the first coupling to connect the second coupling to the first coupling. The link mechanism disconnects the second coupling from the first coupling against a biasing force of the biasing member so as to block a transmission of the drive force from the drive gear to the sheet feeding roller with an opening of the openable/closable part.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Hereinafter, with reference the attached drawings, a printer 1 (an example of an image forming apparatus) according to one embodiment of the present disclosure will be described.

Figure 1:
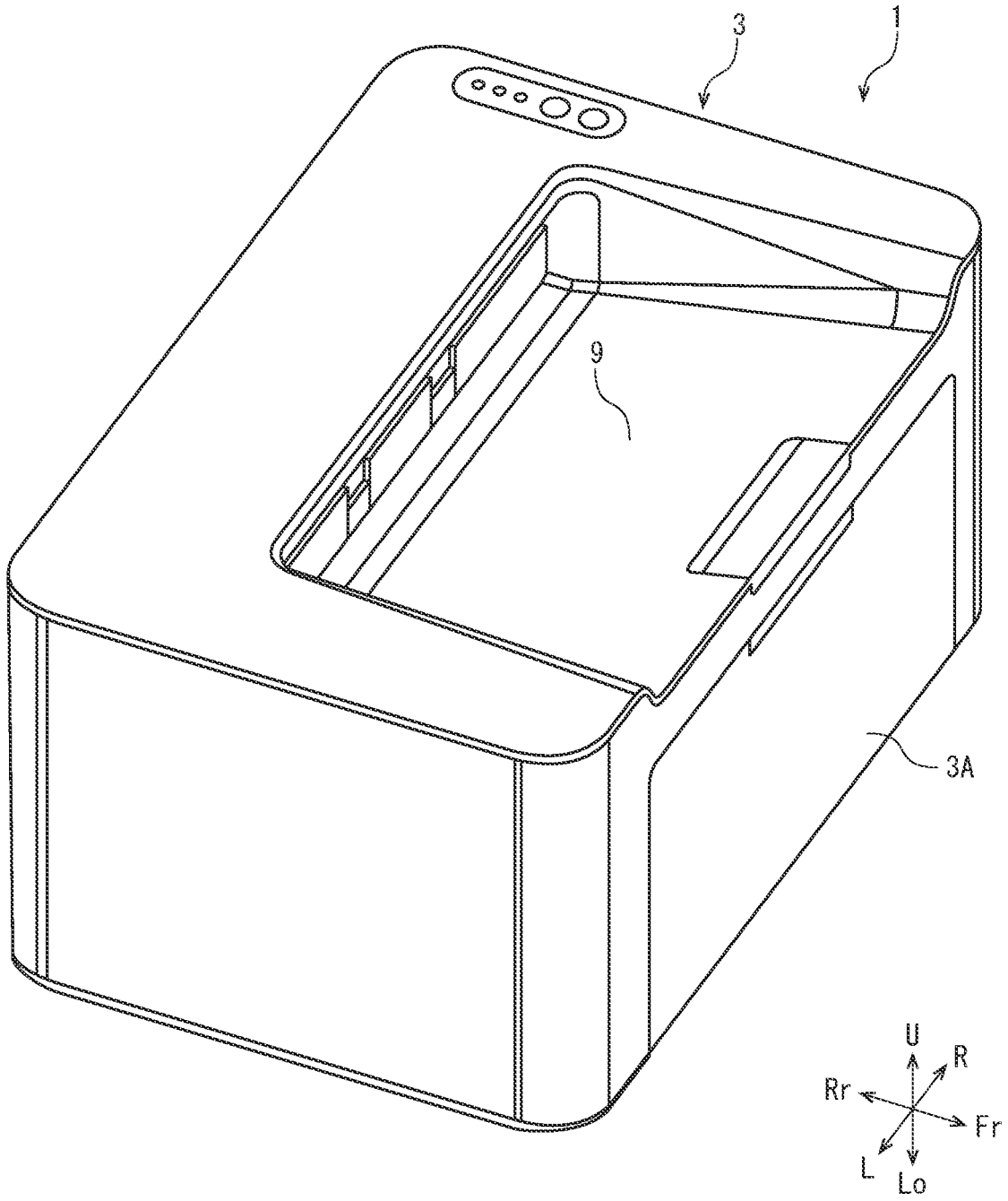
FIG. 1 is a perspective view showing an external appearance of a printer according to one embodiment of the present disclosure.
Figure 2:
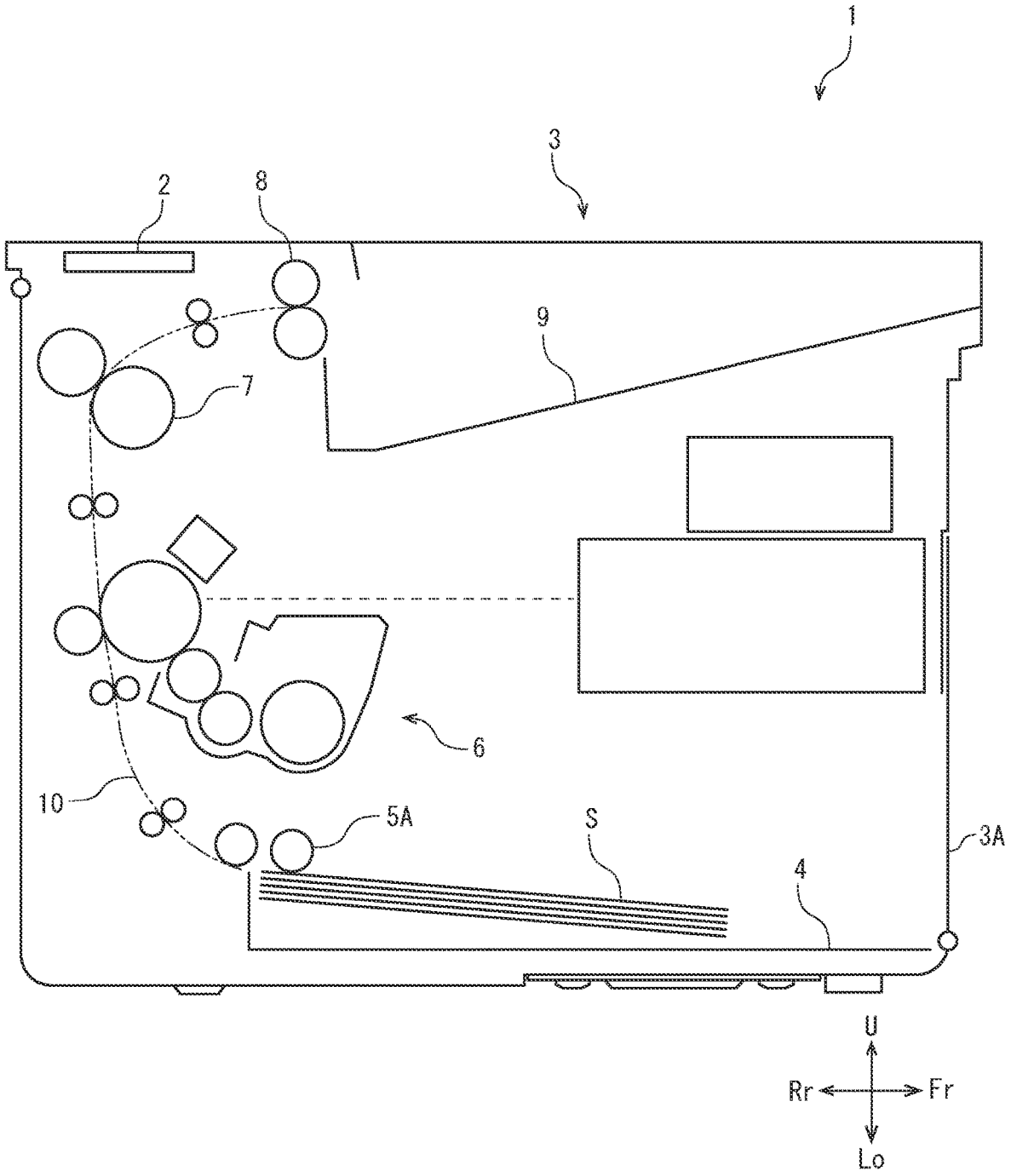
FIG. 2 is a left side view schematically showing a structure of the printer according to the embodiment of the present disclosure.

First, an entire structure of the printer 1 will be described. FIG. 1 is a perspective view showing an external appearance of the printer 1. FIG. 2 is a left side view schematically showing an inner structure of the printer 1. Hereinafter, the front side of the paper surface on which FIG. 2 is drawn is defined as a front side of the printer 1, and the right-and-left direction is described with reference to the direction in which the printer 1 is viewed from the front side. In each drawing, U, Lo, L, R, Fr and Rr indicate upper, lower, left, right, front and rear, respectively.

The printer 1 includes the rectangular parallelepiped main body housing 3. In the lower portion of the main body housing 3, a sheet feeding cassette 4 in which a sheet S is placed and a sheet feeding roller 5A which feeds the sheet S from the sheet feeding cassette 4 are provided. On the front side surface of the main body housing 3, a front door 3A is provided in an openable and closable manner around a hinge provided in the lower portion. The sheet S is placed on the sheet feeding tray 4 by opening the front door 3A. Above the sheet feeding tray 3, an image forming device 6 which forms a toner image in an electrophotographic manner and a fixing device 7 which fixes the toner image on the sheet S are provided. In the upper portion of the main body housing 3, a discharge rollers pair 8 which discharges the sheet S on which the toner image is fixed and a discharge tray 9 on which the discharged sheet S is stacked are provided.

The image forming device 6 includes: a photosensitive drum whose potential is changed by irradiation of light; a charging device which charges the photosensitive drum by discharging; an exposure device which emits laser light according to image data; a development device which supplies a toner to the photosensitive drum; a transfer roller which generates a transfer bias; and a cleaning device which removes the toner remaining on the photosensitive drum. A toner container which supplies the toner to the development device is connected to the development device.

Inside the main body housing 3, a conveyance path 10 is provided from the sheet feeding roller 5A to the discharge rollers pair 8 via the image forming device 6 and the fixing device 7. On the conveyance path 10, a plurality of conveyance rollers pairs which conveys the sheet is provided. On the upstream side of the image forming device 6, a registration rollers pair is provided.

Each part of the printer 1 is controlled by a controller 2. The controller 2 includes a processor and a memory. The processor is, for example, a CPU (central processing unit). The memory includes a storage medium such as ROM (Read Only Memory), RAM (Random Access Memory), EEPROM (Electrically Erasable Programmable Read Only Memory), etc. The processor executes various processes by reading and executing control program stored in the memory. The controller 2 may be implemented by an integrated circuit that does not use software.

Next, an outline of the image forming operation of the printer 1 will be described. When a printing job is input to the printer 1 from an external computer or the like, the sheet feeding roller 5A feeds the sheet S from the sheet feeding cassette 4 to the conveyance path 10, the registration rollers pair whose rotation is stopped corrects a skew of the sheet S, and the registration rollers pair feeds the sheet S to the image forming device 6 at a predetermined timing. In the image forming device 6, the charging device charges the photosensitive drum to a predetermined potential, the exposure device writes an electrostatic latent image on the photosensitive drum, the development device develops the electrostatic latent image using the toner supplied from the toner container, and the transfer roller transfers the toner image to the sheet S. Subsequently, the fixing device 7 fuses the toner image while holding and conveying the sheet S to fix the toner image on the sheet S, and the discharge rollers pair 8 discharges the sheet S to the discharge tray 9. The cleaning device removes the toner remaining on the photosensitive drum.

Figure 3:
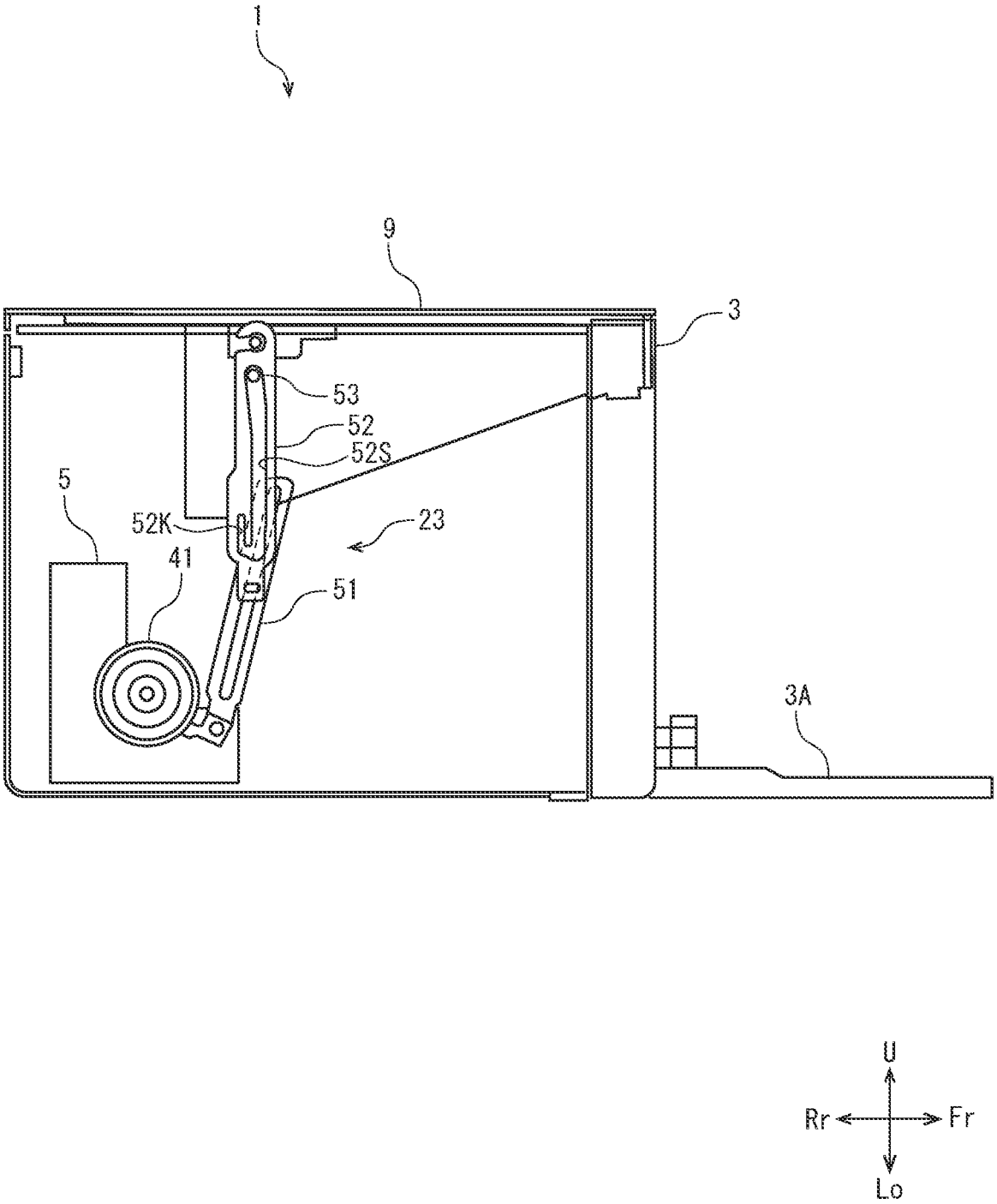
FIG. 3 is a left side view schematically showing a link mechanism according to the embodiment of the present disclosure.
Figure 4:
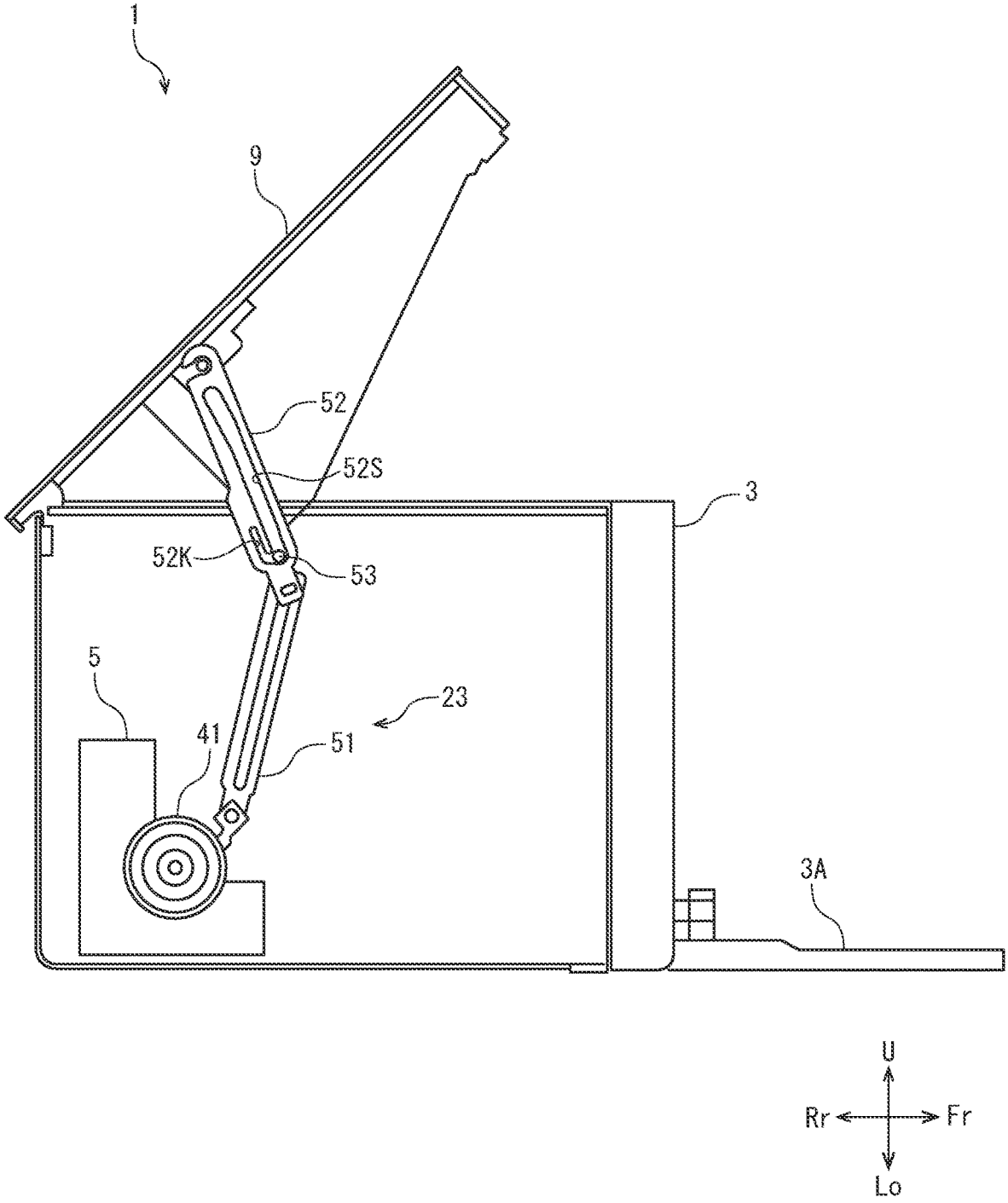
FIG. 4 is a left side view schematically showing the link mechanism according to the embodiment of the present disclosure.
Figure 5A:
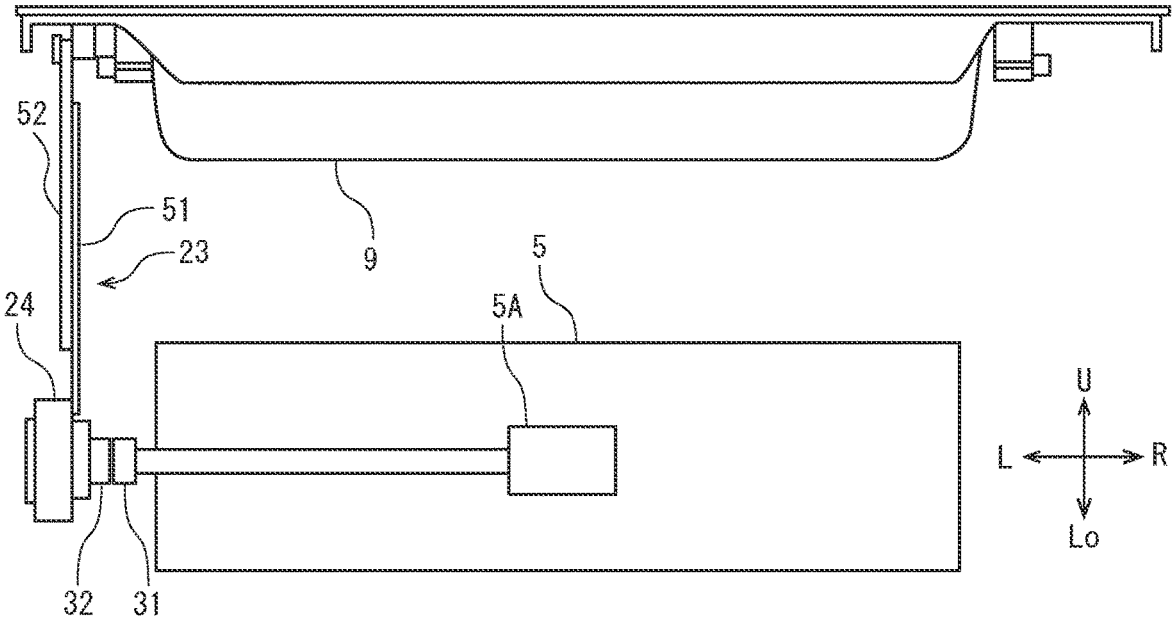
FIG. 5A is a front view schematically showing the link mechanism according to the embodiment of the present disclosure.
Figure 5B:
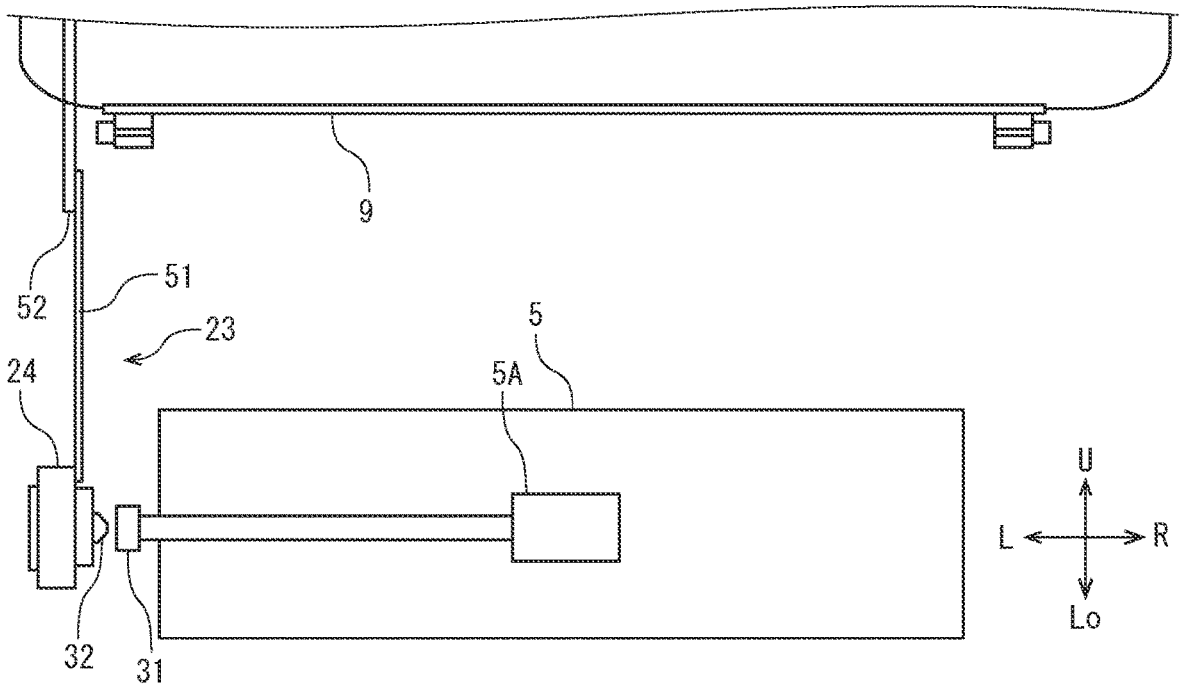
FIG. 5B is a front view schematically showing the link mechanism according to the embodiment of the present disclosure.
Figure 6:
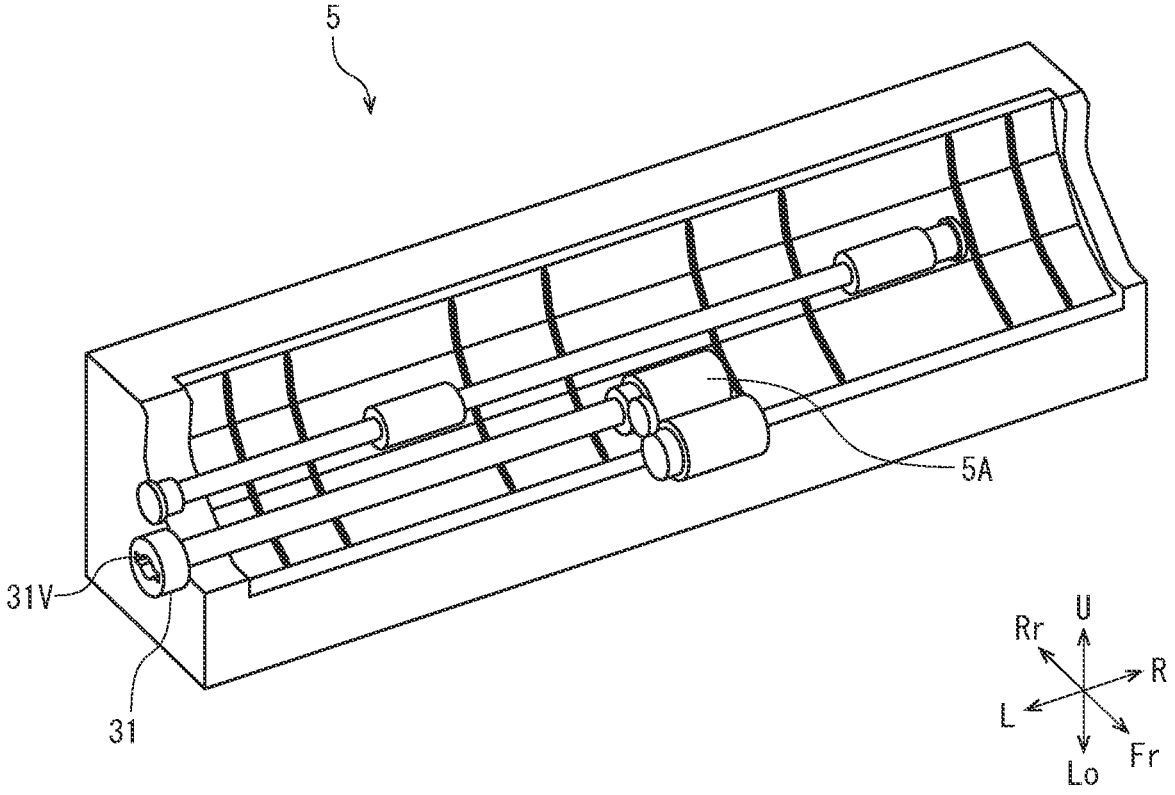
FIG. 6 is a perspective view showing a sheet feeding device provided with a sheet feeding roller and a first coupling according to the embodiment of the present disclosure.
Figure 7A:
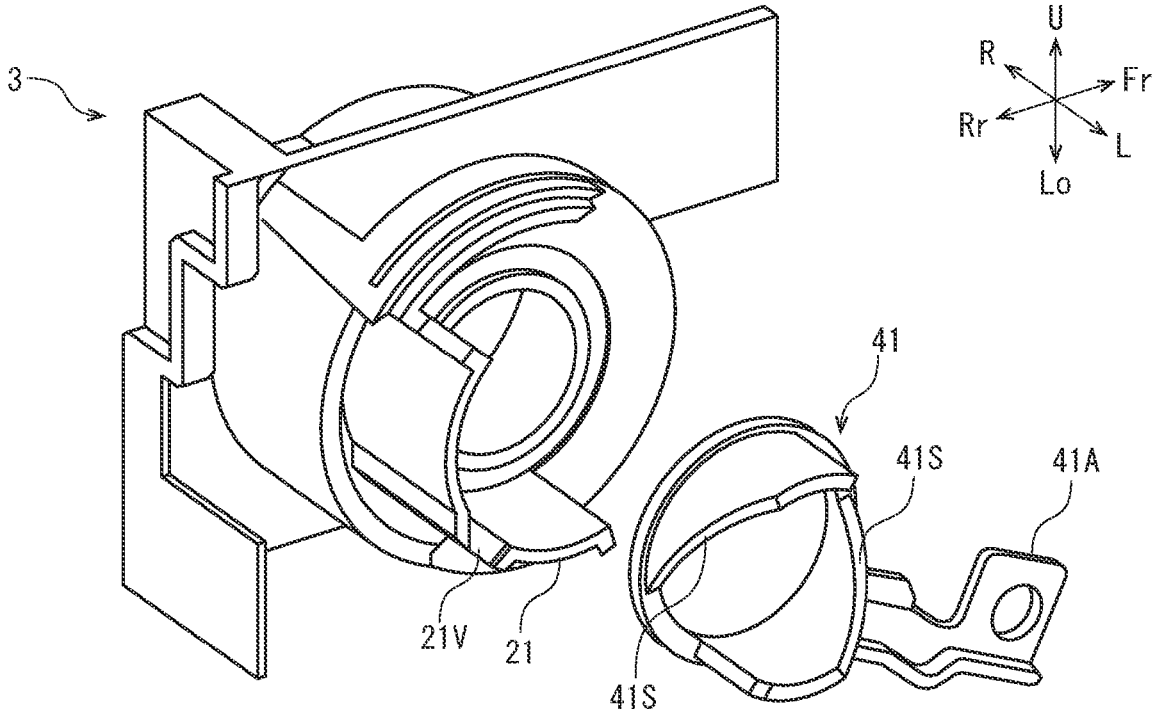
FIG. 7A is a perspective view showing a state where a rotating member is attached to a main body housing.
Figure 7B:
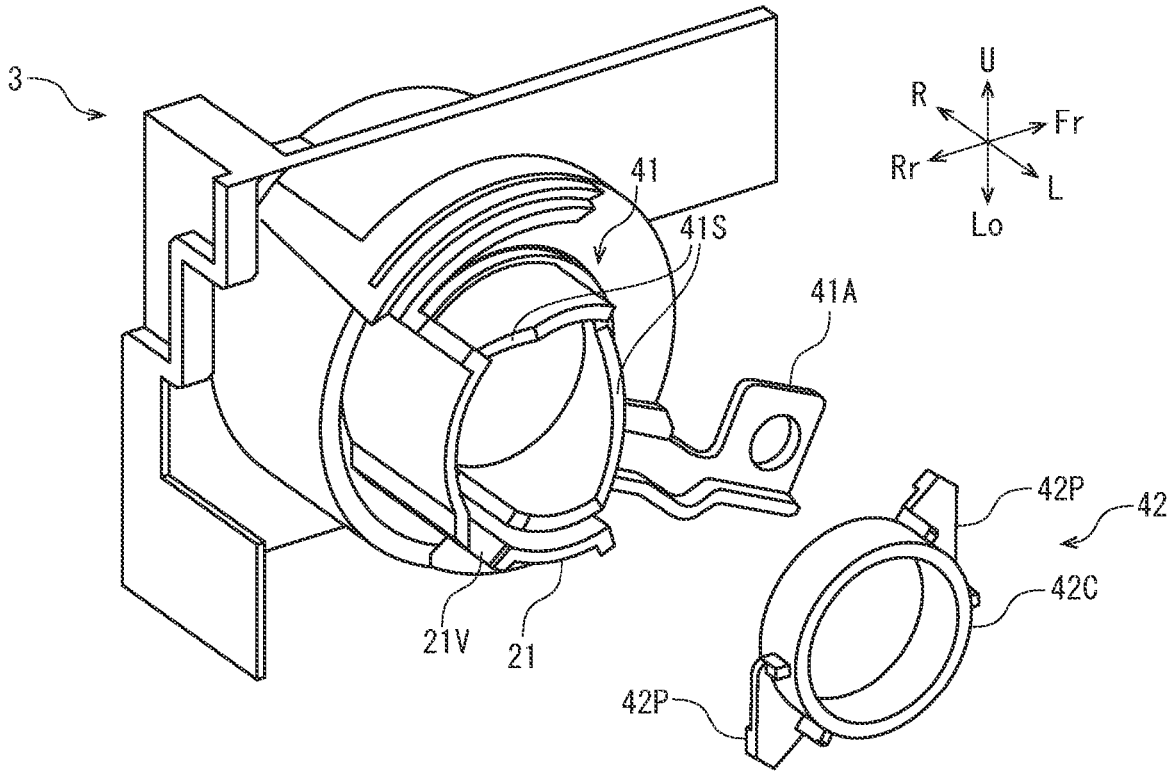
FIG. 7B is a perspective view showing a state where a sliding member is attached to the main body housing.
Figure 8A:
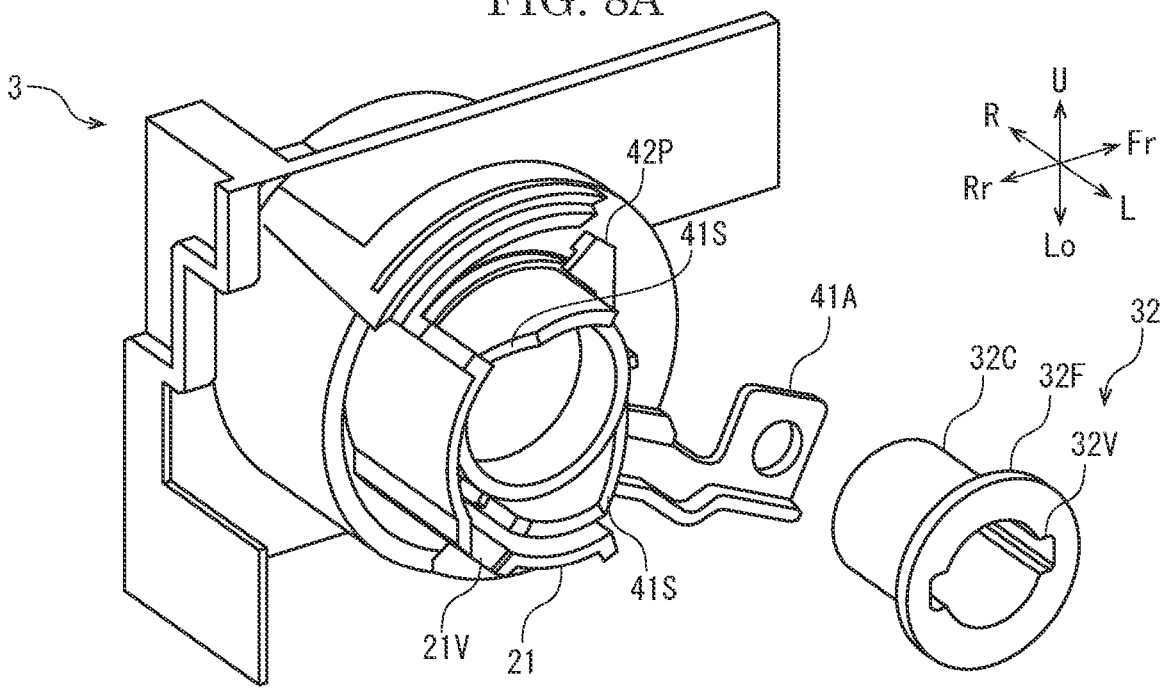
FIG. 8A is a perspective view showing a state where a second coupling is attached to the main body housing.
Figure 8B:
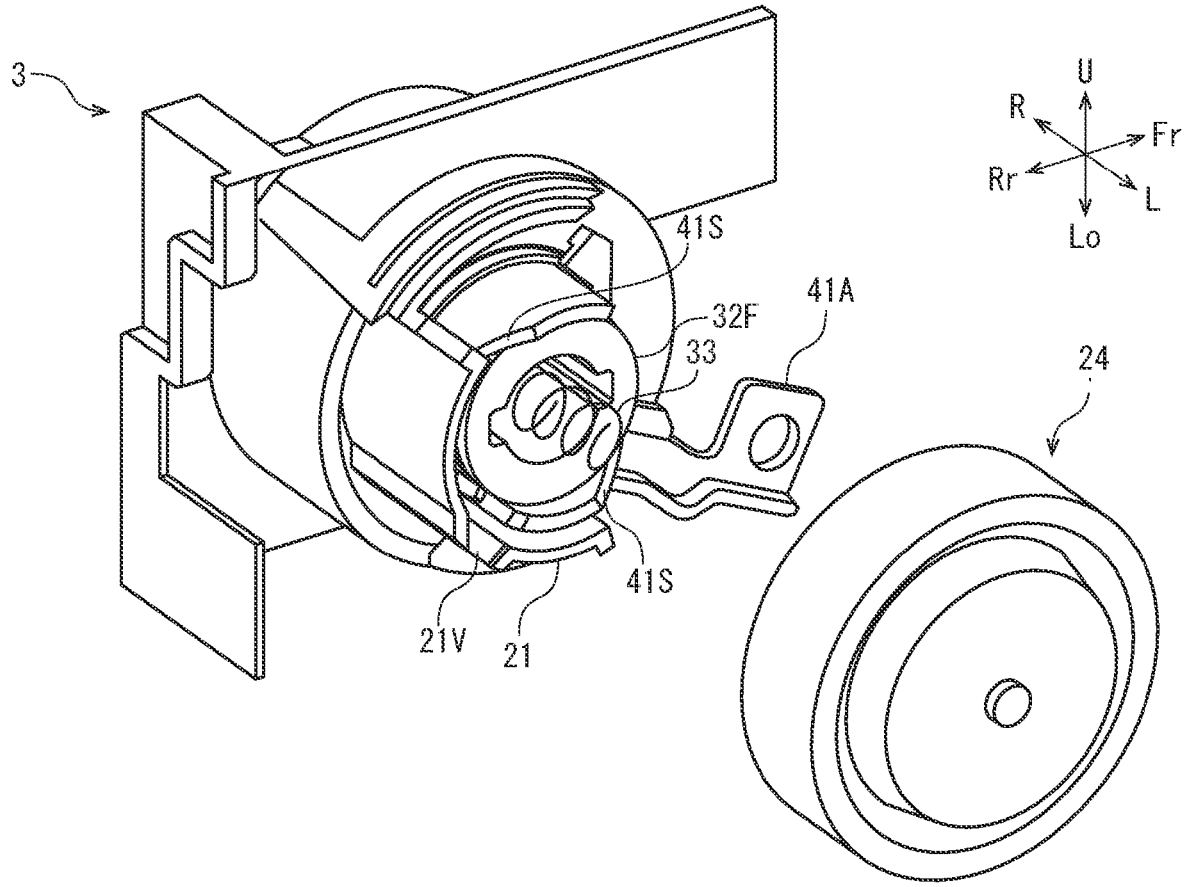
FIG. 8B is a perspective view showing a state where a drive gear is attached to the main body housing.
Figure 9:
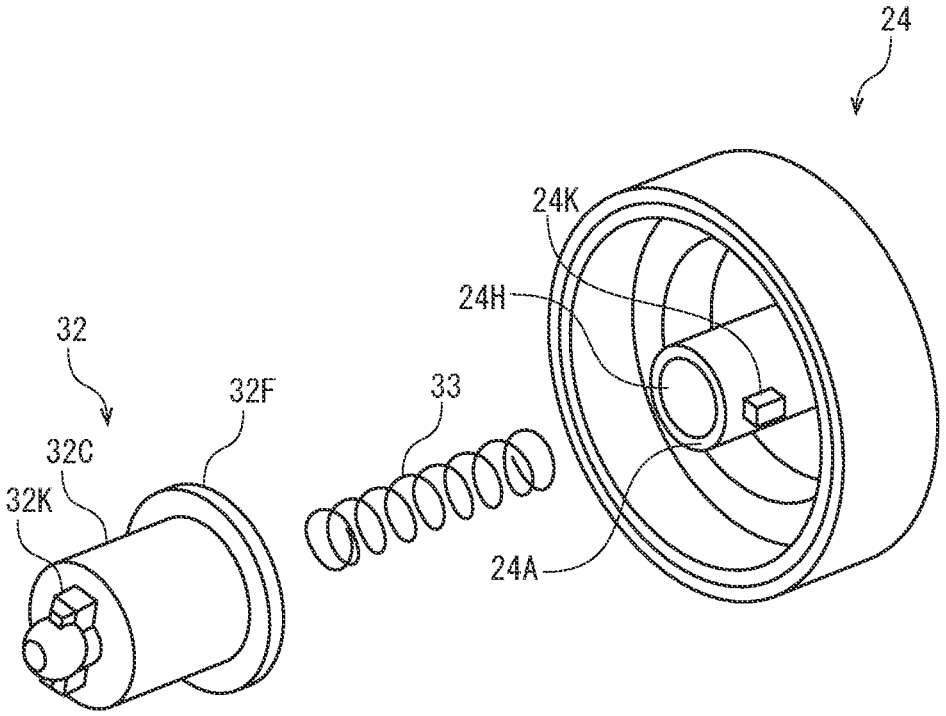
FIG. 9 is a perspective view showing the drive gear, a biasing member and the second coupling according to the embodiment of the present disclosure.
Figure 10:
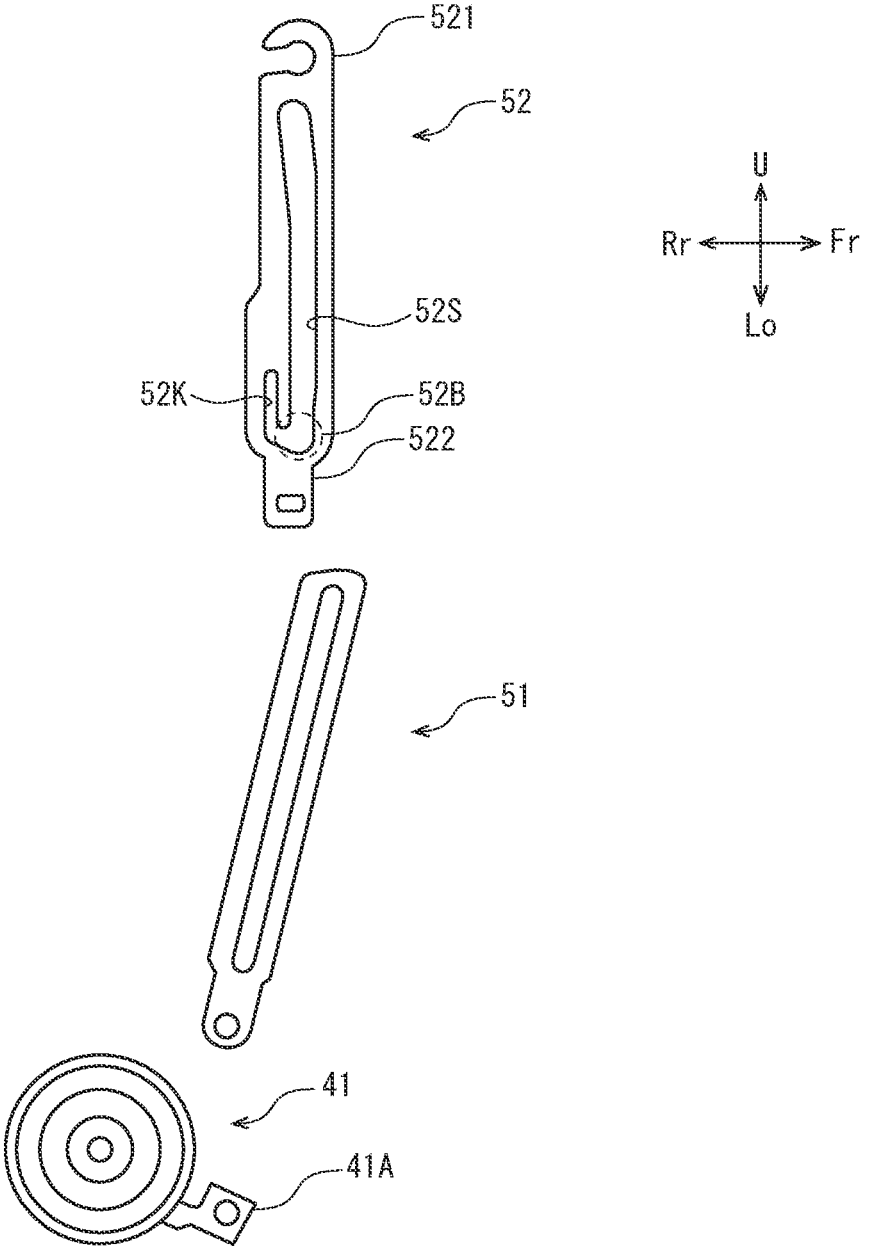
FIG. 10 is a disassembled view showing the link mechanism according to the embodiment of the present disclosure.

Next, a mechanism for disconnecting the sheet feeding roller 5A from a drive gear 24 will be described in detail. FIG. 3 and FIG. 4 are left side views schematically showing a link mechanism 23. FIG. 5A and FIG. 5B are front views schematically showing the link mechanism 23. FIG. 6 is a perspective view showing a sheet feeding device 5 including the sheet feeding roller 5A and a first coupling 31. FIG. 7A is a perspective view showing a state where a rotating member 41 is attached to the main body housing 3. FIG. 7B is a perspective view showing a state where a sliding member 42 is attached to the main body housing 3. FIG. 8A is a perspective view showing a state where a second coupling 32 is attached to the main body housing 3. FIG. 8B is a perspective view showing a state where the drive gear 24 is attached to the main body housing 3. FIG. 9 is a perspective view showing the drive gear 24, a biasing member 33, and the second coupling 32. FIG. 10 is a disassembled view showing the link mechanism 23.

The printer 1 includes: the main body housing 3: the discharge tray 9 (an example of an opening/closing part) provided in the main body housing 3 around the hinge; the sheet feeding tray 4 on which the sheet S is placed; the image forming device 6 which forms an image on the sheet S; the sheet feeding roller 5A which feeds the sheet S placed on the sheet feeding tray 4 to the image forming device 6; the first coupling 31 provided in the sheet feeding roller 5A; the drive gear 24 which transmits a drive force to the sheet feeding roller 5A; the second coupling 32 provided coaxially with the drive gear 24, rotatable following the drive gear 24, slidable in an axial direction relative to the drive gear 24 and capable of fitting to the first coupling 31; the biasing member 33 which biases the second coupling 32 to the first coupling 31 to connect the second coupling 32 with the second coupling 32; and the link mechanism 23 which disconnects the second coupling 32 from the first coupling 31 against a biasing of the biasing member 33 with an opening of the discharge tray 9. The details are as follows.

[Main Body Housing, Opening/Closing Part] In the left side portion of the main body housing 3, a support part 21 which supports the drive gear 24 and the link mechanism 23 is provided. The support part 21 is formed in a shell-like shape constituting a part of a cylinder whose diameter is smaller than the inner diameter of the drive gear 24 to be described later and larger than the outer diameter of the rotating member 41, and supports the drive gear 24 and the rotating member 41 coaxially with each other. The discharge tray 9 (an example of an opening/closing part) is formed as a member separate from the main body housing 3. In the upper portion of the main body housing 3, an opening corresponding to the discharge tray 9 is formed, and the rear end portion of the discharge tray 9 and the rear end portion of the opening are connected by a hinge. The discharge tray 9 can be opened upward around the hinge.

[Sheet Feeding Roller, First Coupling] The sheet feeding device 5 (see FIG. 6) is provided in the rear lower portion of the main body housing 3. The sheet feeding device 5 includes the sheet feeding roller 5A. The sheet feeding roller 5A feeds the sheet S one by one to the conveyance path 10 by a frictional resistance of the outer circumferential surface to the sheet S. In the left end portion of the sheet feeding roller 5A, the first coupling 31 to which the second coupling 32 described later can be fitted is provided.

[Drive Gear, Second Coupling and Biasing Member] The drive gear 24 (see FIG. 9) transmits a drive force generated by a drive unit (not shown) including a motor and a gear train to the sheet feeding roller 5A through the second coupling 32 and the first coupling 31. The shaft 24A of the drive gear 24 is provided with a key 24K projecting in the radial direction. The shaft 24A has a hollow portion 24H.

The second coupling 32 (see FIG. 8 and FIG. 9) has a cylindrical part 32C having a diameter larger than that of the shaft 24A of the drive gear 24. A flange part 32F is provided in the left end portion of the cylindrical part 32C, and a key 32K projecting in a radial direction is provided in the right end portion of the cylindrical part 32C. The first coupling 31 has a groove 32V in which the key 32K of the second coupling 32 can be fitted. On the inner circumferential surface of the cylindrical part 32C of the second coupling 32, the groove 32V in which the key 24K of the drive gear 24 can be fitted is provided. The biasing member 33 is a coil spring, inserted into the hollow portion 24H of the drive gear 24 and biases the second coupling 32 rightward.

The link mechanism 23 includes the rotating member 41, a first link member 51, the sliding member 42, a second link member 52, and a pin 53. The rotating member 41 is provided in the main body housing 3 so as to be rotatable coaxially with the drive gear 24. The first link member 51 connects the discharge tray 9 and the rotating member 41, rotates the rotating member 41 in a forward direction with the opening of the discharge tray 9 and rotates the rotating member 41 in a reverse direction with the closing of the discharge tray 9. The sliding member 42 is provided in the main body housing 3 so as to be slidable in the axial direction, pushes out the second coupling 32 against the biasing force of the biasing member 33 when the rotating member 41 is rotated in the forward direction, and release the pushing out of the second coupling 32 when the rotating member 41 is rotated in the reverse direction. The second link member 52 connects the discharge tray 9 and the first link member 51, and has an upper end portion (an example of a first end portion 521) rotatable relative to the discharge tray 9 and a lower end portion (an example of a second end portion 522) slidable in the longitudinal direction of the first link member 51 relative to the first link member 51. The second link member 52 has a slit 52S connecting the first end portion 521 to the second end portion 522. The pin 53 is provided in the main body housing 3 inside the slit 52S.

The support part 21 of the main body housing 3 (see FIG. 7A) has a groove 21V extending in the axial direction, and the second coupling 32 (see FIG. 8 and FIG. 9) has the flange part 32F. The sliding member 42 (see FIG. 7B) has an annular portion 42C and protrusions 42P. The annular portion 42C comes into contact with the first coupling 31 side surface of the flange part 32F. The protrusions 42P protrude outside in the radial direction from the annular portion 42C and are capable of fitting in the groove 21V. The annular portion 42C has an inner diameter larger than the outer diameter of the cylindrical part 32C of the second coupling 32.

The rotating member 41 (see FIG. 7A) has a shape in which a part of a cylindrical member is notched. The inner diameter of the rotating member 41 is larger than the outer diameter of the sliding member 42. The rotating member 41 has an inclined part 42S formed such that a contact point between the inclined part 42S and the protrusion 42P of the sliding member is shifted in a direction opposite to the biasing direction of the biasing member 33 when the rotating member 41 is rotated in the forward direction. The rotating member 41 has an arm 41A protruding in the radial direction. The lower end portion of the first link member 51 is coupled to the arm 41A in a turnable manner.

The sliding resistance of the second end portion 522 side portion of the slit 52S with respect to the pin 53 is larger than the sliding resistance of the first end portion 521 side portion of the slit 52S. Specifically (see FIG. 10), the width of the second end portion 522 side portion of the slit 52S is narrower than that of the first end portion 521 side portion of the slit 52S. The width of the first end portion 521 side portion of the slit 52S is equal to or larger than the diameter of the pin 53, while the width of the second end portion 522 side portion of the slit 52S is narrower than the diameter of the pin 53. The second link member 52 is made of resin having flexibility, and when the second end portion 522 side portion of the slit 52S slides with respect to the pin 53, the second end portion 522 side portion of the slit 52S is pushed and spread out by the pin 53.

The second link member 52 has a notch 52K. The notch 52K is formed so as to communicate with the slit 522 on the second end portion 52 side and to turn to the first end portion 521 side, and is narrower in width than the second end portion 522 side portion of the slit 52S. A portion adjacent to the notch 52K on the second end portion 522 side portion of the slit 52S is further narrowed in width. When the pin 53 is held in the boundary portion 52B between the slit 52S and the notch 52K, the discharge tray 9 is stopped. When the pin 53 is held in the boundary portion 52B between the slit 52S and the notch 52K, the inclination angle (a rotational angle) of the discharge tray 9 with respect to the horizontal surface is within a range of 40° to 50° (for example, 45°). The first end portion 521 side portion of the slit 52S is inclined at a shallow angle (for example, about 5°) with respect to the second end portion 522 side portion. According to this configuration, when the pin 53 shifts from the first end portion 521 side portion to the second end portion 522 side portion of the slit 52S, the operating feeling of the discharge tray 9 is changed.

Each of the above members is attached in the following manner. First, the rotating member 41 is inserted into the support part 21 of the main body housing 3 (see FIG. 7A). Next, the sliding member 42 is inserted into the rotating member 41 (see FIG. 7B). At this time, the protrusion 42P of the sliding member 42 is inserted into the groove 21V of the support part 21 of the main body housing 3. Next, the second coupling 32 is inserted into the sliding member 42. At this time, the flange part 32F of the second coupling 32 comes into contact with the annular portion 42C of the sliding member 42. Next, the drive gear 24 is attached to the support part 21. At this time, the biasing member 33 is inserted between the second coupling 32 and the drive gear 24. Finally, the first link member 51 and the second link member 52 are connected to the rotating member 41 and the discharge tray 9 (see FIG. 3).

Figure 11A:
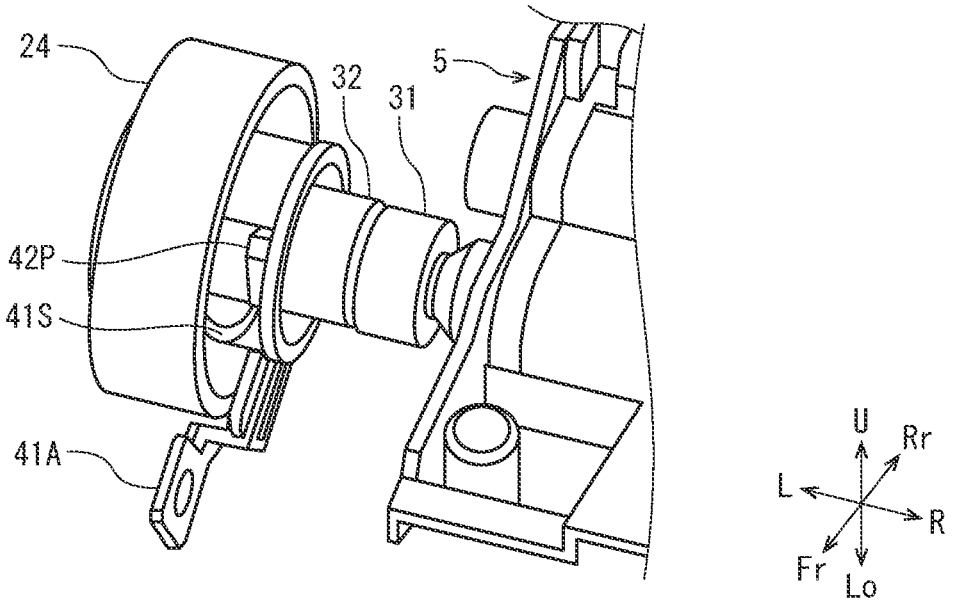
FIG. 11A is a perspective view showing the second coupling when a discharge tray is closed.
Figure 11B:
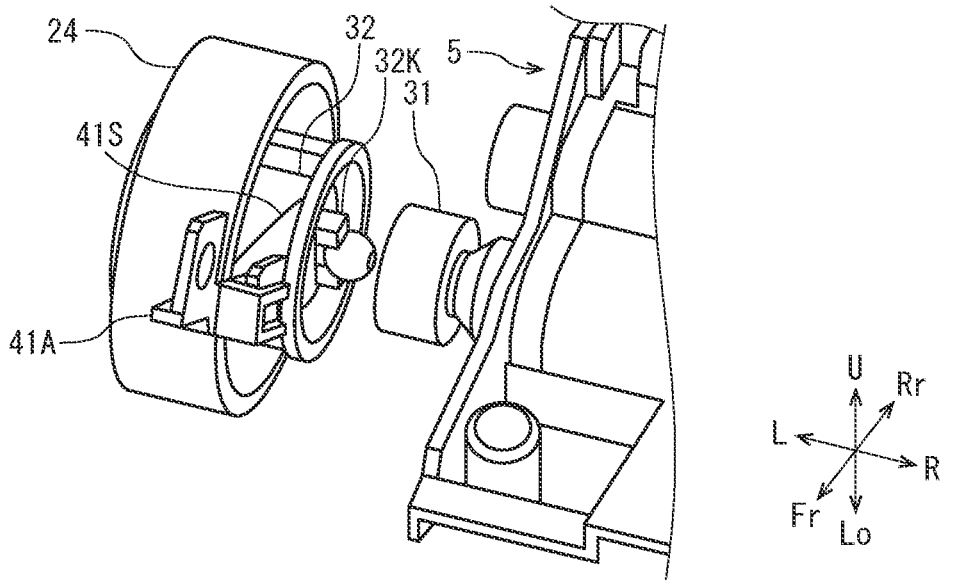
FIG. 11B is a perspective view showing the second coupling when the discharge tray is opened.

FIG. 11A is a perspective view showing the second coupling 32 when the discharge tray 9 is closed. FIG. 11B is a perspective view showing the second coupling 32 when the discharge tray 9 is opened. When the discharge tray 9 is closed (see FIG. 3), the second coupling 32 is biased rightward by the biasing member 33, whereby the second coupling 32 is connected to the first coupling 31 (see FIG. 5A and FIG. 11A). When a user lifts the front end portion of the discharge tray 9, as shown in FIG. 4, FIG. 5B and FIG. 11B, the rotating member 41 is rotated in the counterclockwise direction through the first link member 51 and the second link member 52. Then, as shown in FIG. 11B, the contact point between the inclined part 42S of the rotating member 41 and the protrusion 42P of the sliding member 42 shifts leftward, whereby the sliding member 42 is pushed out leftward. Accordingly, the second coupling 32 is pushed out leftward, and the second coupling 32 is disconnected from the first coupling 31.

When the discharge tray 9 is lifted, a frictional resistance to the pin is not generated in the first end portion 521 side portion of the slit 52S of the second link member 52. On the other hand, in the second end portion 522 side portion of the slit 52S, the slit 52S is spread out by the pin 53 and a frictional resistance is generated. When the discharge tray 9 is lifted at about 45° to the horizontal surface, the pin 53 is held in the boundary portion 52B between the slit 52S and the notch 52K. At this time, the portion between the slit 52S and the notch 52K is elastically deformed to restrain the pin 53, and the discharge tray 9 is stopped.

When the user pushes down the discharge tray 9, the pin 53 is released from the boundary portion 52B. Thereafter, in the second end portion 522 side portion of the slit 52S, the discharge tray 9 is gradually lowered by the frictional resistance between the slit 52S and the pin 53. On the other hand, in the first end portion 521 side portion of the slit 52S, since the frictional resistance is not generated, the discharge tray 9 is surely closed.

According to the printer 1 according to the embodiment described above, since the link mechanism 23 which disconnects the second coupling 32 from the first coupling 31 against the biasing by the biasing member 33 with the opening of the discharge tray 9 is provided, it becomes possible to disconnect the sheet feeding roller 5A from the drive gear 24 easily.

Further, according to the printer 1 according to the present embodiment, since the sliding resistance is generated between the slit 52S and the pin 53, an impact caused by opening and closing of the discharge tray 9 can be suppressed.

Further, according to the printer 1 according to the present embodiment, since the sliding resistance of the second end portion 522 side portion of the slit 52S with respect to the pin 53 is larger than the sliding resistance of the first end portion 521 side portion of the slit 52S, an impact caused by the closing the discharge tray 9 can be suppressed. Further, it becomes possible to close the discharge tray 9 securely.

Further, according to the printer 1 of the present embodiment, since the sliding resistance is generated by making the width of the slit 52S narrower than the diameter of the pin 53, the impact can be suppressed with a simple configuration.

Further, according to the printer 1 according to the present embodiment, the second link member 52 has the notch 52K which is formed so as to communicate with the slit 52S on the second end portion 522 side and to turn to the first end portion 521 side and has a width narrower than the second end portion 522 side portion of the slit 52S. Then, when the pin 53 is held in the boundary 52B between the slit 52S and the notch 52K, the discharge tray 9 can be stopped. Therefore, the discharge tray 9 can be stopped at a predetermined inclination angle. Further, since the portion between the slit 52S and the notch 52K is deformed by a slight force, the discharge tray 9 can be closed only by applying a force to the discharge tray 9.

According to the printer 1 according to the present embodiment, an inclination angle of the discharge tray 9 with respect to the horizontal surface is 40° or more to 50° or less when the pin 53 is held in the boundary portion 52B between the slit 52S and the notch 52K. In order to perform a work above the printer 1, it is more preferable, the larger the inclination angle is. On the other hand, as the inclination angle of the discharge tray 9 is larger, it is necessary to ensure a larger space above the printer 1. However, in a case where a shelf or the like is disposed above the printer 1, the inclination angle of the discharge tray 9 is limited. According to the configuration, it becomes possible to ensure a sufficient space for work within a range where a utilization efficiency for the space above the printer 1 is not deteriorated.

According to the printer 1 according to the present embodiment, the opening/closing part is the discharge tray 9 provided in the upper portion of the main body housing 3 and on which the image formed sheet S is stacked. According to the configuration, light is incident on the inside of the main body housing 3 by opening the discharge tray 9 so that it becomes easy to remove the sheet S.

The above embodiment may be modified as follows.

The above embodiment shows an example where the width of the second end portion 522 side portion of the slit 52S is narrower than the diameter of the pin 53, but the slit 52S may be formed such that the width is narrower than the diameter of the pin 53 along the entire area. According to the configuration, it becomes possible to suppress the impact caused when the discharge tray 9 is brought into contact with the opening of the main body housing 3.

The above embodiment shows an example where the sliding resistance of the second end portion 522 side portion of the slit 52S to the pin 53 is larger than the sliding resistance of the first end portion 521 side portion of the slit 52S to the pin 53, but the slit 52S may be formed such that the sliding resistance becomes larger gradually from the first end portion 521 to the second end portion 522. According to the configuration, it becomes possible to suppress the impact caused when the discharge tray 9 is brought into contact with the opening of the main body housing 3.

The above embodiment shows an example where the opening/closing part is the discharge tray 9, but when the opening/closing part is provided on the rear side surface of the main body housing, it may be configured to disconnect the second coupling 32 from the first coupling 31 with the opening of the opening/closing part.

Although one aspect of the embodiment according to the present disclosure is described, the present disclosure is not limited to the above embodiment. The present disclosure may be modified, substituted, or modified in various ways without departing from the spirit of the technical idea.

The invention claimed is:

1. An image forming apparatus comprising:

a main body housing;

an openable/closable part provided in the main body housing in a turnable manner around a hinge;

a sheet feeding tray on which a sheet is placed;

an image forming device which forms an image on the sheet;

a sheet feeding roller which is rotated around an axis parallel to the hinge and feeds the sheet placed on the sheet feeding tray to the image forming device;

a first coupling to be coaxially distanced from the sheet feeding roller;

a drive gear which transmits a drive force to the sheet feeding roller;

a second coupling provided coaxially with the drive gear, rotatable following the drive gear, slidable relative to the drive gear in an axial direction and capable of fitting to the first coupling;

a biasing member which biases the second coupling to the first coupling to connect the second coupling to the first coupling; and a link mechanism which disconnects the second coupling from the first coupling against a biasing force of the biasing member so as to block a transmission of the drive force from the drive gear to the sheet feeding roller with an opening of the openable/closable part.

2. The image forming apparatus according to claim 1, wherein, the link mechanism includes:

a rotating member provided in the main body housing in a rotatable manner coaxially with the drive gear;

a first link member connecting the openable/closable part to the rotating member, rotating the rotating member in a forward direction with the opening of the openable/ closable part and rotating the rotating member in a reverse direction with a closing of the openable/closable part; and a sliding member provided in the main body housing in a slidable manner in an axial direction of the sheet feeding roller, pushing out the second coupling against the biasing of the biasing member when the rotating member is rotated in the forward direction, and releasing the pushing out of the second coupling when the rotating member is rotated in the reverse direction.

3. The image forming apparatus according to claim 2, wherein the main body housing has a groove extending in the axial direction, the second coupling has a flange part, the sliding member has an annular portion coming into contact with a surface of the flange part on a side of the first coupling and a protrusion protruding outward in a radial direction from the annular portion and fitting to the groove, and the rotating member has an inclined part which is formed such that a contact point between the inclined part and the protrusion is shifted in an opposite direction to a biasing direction of the biasing member when the rotating member is rotated in the forward direction.

4. The image forming apparatus according to claim 2, wherein a turning direction of the openable/closable part when the openable/closable part is opened is the same as a rotating direction of the rotating member.

5. The image forming apparatus according to claim 2, wherein the link mechanism includes:

a second link member connecting the openable/closable part and the first link member, having a first end portion rotatable with respect to the openable/closable part and a second end portion slidable in a longitudinal direction of the first link member, and having a slit connecting the first end portion and the second end portion; and a pin provided in the main body housing and fitting to the slit, wherein a sliding resistance is generated between the slit and the pin.

6. The image forming apparatus according to claim 5, wherein the sliding resistance of the slit to the pin is larger on a side of the second end portion than on a side of the first end portion.

7. The image forming apparatus according to claim 5, wherein the sliding resistance is generated due to a fact that a width of the slit is narrower than a diameter of the pin.

8. The image forming apparatus according to claim 5, wherein the second link member has a notch communicated with the slit on a side of the second end portion, formed so as to turn to a side of the first end portion and having a width narrower than a width of the slit on a side of the second end portion, and when the pin is held in a boundary portion between the slit and the notch, the openable/closable part is stopped.

9. The image forming apparatus according to claim 8, wherein a rotational angle of the openable/closable part to the horizontal surface is 40° or more to 50° or less.

10. The image forming apparatus according to claim 5, wherein the portion of the slit on the side of the first end portion is inclined to the portion of the slit on the side of the second end portion.

11. The image forming apparatus according to claim 1, wherein the openable/closable part is a discharge tray provided in an upper portion of the main body housing and on which a sheet on which an image is formed is stacked.

* * * * *